US007862247B2

(12) United States Patent
Watanabe et al.

(10) Patent No.: US 7,862,247 B2
(45) Date of Patent: Jan. 4, 2011

(54) PRINTER WITH GEAR FITTING MEMBER FOR MOUNTING DRIVE AND IDLER GEARS

(75) Inventors: Hideki Watanabe, Chiba (JP); Shuji Tozaki, Chiba (JP); Takumi Seino, Chiba (JP)

(73) Assignee: Seiko Instruments Inc. (JP)

( * ) Notice: Subject to any disclaimer, the term of this patent is extended or adjusted under 35 U.S.C. 154(b) by 1069 days.

(21) Appl. No.: 10/590,587

(22) PCT Filed: Feb. 8, 2005

(86) PCT No.: PCT/JP2005/001855

§ 371 (c)(1),
(2), (4) Date: Oct. 25, 2006

(87) PCT Pub. No.: WO2005/082634

PCT Pub. Date: Sep. 9, 2005

(65) Prior Publication Data

US 2008/0019757 A1 Jan. 24, 2008

(30) Foreign Application Priority Data

Feb. 26, 2004 (JP) ..... 2004-052098

(51) Int. Cl.
*B41J 11/00* (2006.01)
*B41J 29/02* (2006.01)
*B41J 29/00* (2006.01)

(52) U.S. Cl. ..... 400/691; 400/636.2

(58) Field of Classification Search ..... 400/636.2
See application file for complete search history.

(56) References Cited

U.S. PATENT DOCUMENTS 4,763,031 A * 8/1988 Wang ..... 310/83
4,930,916 A * 6/1990 Fujiwara ..... 400/636
5,198,836 A * 3/1993 Saito et al. ..... 347/222
6,831,670 B2 * 12/2004 Fujiwara ..... 347/222

(Continued)

FOREIGN PATENT DOCUMENTS

JP 03118173 A * 5/1991

(Continued)

*Primary Examiner*—Daniel J Colilla
(74) *Attorney, Agent, or Firm*—Adams & Wilks

(57) ABSTRACT

Provided is a printer that employs a platen roller as conveying means, for which the accuracy of the assembly of the constituents of a drive transmission mechanism that drives a platen roller is increased, and the heat releasing function of a motor that is a drive source is also improved, so that downsizing and increasing output can be coped with. Therefore, according to the present invention, a printer comprises: a platen roller, for conveying a recording sheet, a print head, arranged opposite the platen roller, a drive unit, for rotating the platen roller, and a main frame, including a pair of side walls that can rotatably support the platen roller, wherein the drive unit includes: a motor; idler gears, for transmitting a rotational force provided by the motor to the platen roller; and a gear fitting member, integrally formed with gear support shafts that support the idler gears, wherein the motor and idler gears are capable of being mounted in the main frame while attached to the gear fitting member, and wherein a drive gear of the motor and the idler gears are stored in a space defined by the gear fitting member and one of the side walls of the main frame.

10 Claims, 4 Drawing Sheets

U.S. PATENT DOCUMENTS

| | | | | |
|---|---|---|---|---|
| 2001/0001273 | A1* | 5/2001 | Mori et al. | 400/660 |
| 2002/0018686 | A1* | 2/2002 | Oshima et al. | 400/636.2 |
| 2004/0114980 | A1* | 6/2004 | Nanno | 400/188 |
| 2005/0022946 | A1* | 2/2005 | Domel | 160/168.1 P |

FOREIGN PATENT DOCUMENTS

| | | | |
|---|---|---|---|
| JP | 07237324 | A * | 9/1995 |
| JP | 09086000 | A * | 3/1997 |

* cited by examiner

PRINTER WITH GEAR FITTING MEMBER FOR MOUNTING DRIVE AND IDLER GEARS

CROSS-REFERENCE TO RELATED APPLICATIONS

This application is a U.S. national stage application of International Application No. PCT/JP2005/001855, filed Feb. 8, 2005, claiming a priority date of Feb. 26, 2004, and published in a non-English language.

TECHNICAL FIELD

The present invention relates to a printer that conveys a sheet using a platen roller, and relates in particular to the structure of a drive transmission mechanism for driving a platen roller.

BACKGROUND ART

As a printer, for example, for printing receipts for cash registers or a portable label printer for printing POS labels for foods and labels for logistics management, a thermal printer is frequently employed wherein a thermal head that includes a heat generating member is pressed against a platen roller, and thermal recording paper is sandwiched between them to perform printing.

According to the structure of a conventional thermal printer, for example, provided at the least are printing means, which includes a thermal head, conveying means, which includes a platen roller, and a drive transmission mechanism, which includes a motor that serves as the drive source for the platen roller, that are arranged in a main frame, and the main frame wherein these members are mounted is fixed at a predetermined position in a printer housing.

FIG. 5 is a perspective view of the drive transmission mechanism of a conventional thermal printer. In FIG. 5, a main frame 30 has substantially a half-rectangular shape consisting of side-walls, opposite the direction of the paper width, and a bottom plate. An insertion hole 30*a* is formed in a right side wall 30R in order to insert a drive gear 21*a* of a motor 21 and to position the motor 21, and beside the insertion hole 30*a*, two gear support shafts 31, 32 are placed so as to project outward. Since appropriate rigidity and durability are required for the main frame 30, generally, sheet metal processing is performed using a metallic material, such as steel, to obtain the main frame 30 having a predetermined shape. Therefore, it is difficult to integrally form the gear support shafts 31, 32, with the main frame 30, and as described above, the gear support shafts 31, 32 are arranged by forced insertion.

Further, idler gears 23, 24, which transmit the drive force from the motor 21 to the platen roller, are fitted over the gear support shafts 31, 32 of the main frame 30, and the motor 21 is attached to the main frame 30 by screws and engages the idler gears 23, 24. The individual parts, such as the idler gears 23, 24 and the motor 21, that are mounted on the main frame 30 in this manner constitute the drive transmission mechanism. Further, there is another thermal printer wherein, although not shown in FIG. 5, a dust cover is provided outside gears to prevent dust from entering the drive transmission mechanism.

Furthermore, as an additional technique related to a drive transmission mechanism for driving a platen roller, the present inventor has proposed thermal printers wherein a housing frame is constituted as a resin frame separable into two upper and lower segments, and wherein a plurality of holding units that freely hold the rotary shafts of a motor and idler gears are formed in the housing frame (see patent documents 1 and 2).

Patent Document 1: Japanese Patent Laid-Open Publication No. 2003-237118

Patent Document 2: Japanese Patent Laid-Open Publication No. 2003-237121

In recent years, a reduction in the sizes of parts, such as gears, has been requested in order to downsize thermal printers, and accordingly, the fitting accuracy for the parts must be more improved. For example, a tolerance for the drive transmission mechanism must be 30 μm or less. This is because when variations in part manufacturing or variations in assembly are large, the inter-shaft distances among the drive gear of the motor, the idler gear and the coupled gear of the platen roller are not fixed, and gear engagement errors at the drive transmission mechanism occur, etc., and cause deterioration of the efficiency of motor torque.

According to the structure of the thermal printer in FIG. 5, the idler gears 23, 24 are fitted over the gear support shafts 31, 32 forcibly inserted into the main frame 30, and engage the drive gear 21a of the motor 21 and the coupled gear of the platen roller. Therefore, many factors are present that adversely affect the tolerance between gears, and accurate assembly of the drive transmission mechanism is limited. That is, the tolerances for the gears is affected by an inclination that occurs when the gear support shafts 31, 32 are forcibly inserted, and also, since the motor 21 is positioned by the insertion hole 30*a* in the main frame 30, it is not easy to mount the motor 21 very accurately. Therefore, problems would arise in that efficiency of transmission of motor torque is deteriorated and in that durability of the drive transmission mechanism is reduced.

In addition, according to the conventional technique, assembly of the drive transmission mechanism is simplified; however, since a resin frame is employed, durability and heat releasing properties are inferior to those of a steel frame. Therefore, in order to cope with downsizing and increasing output, it can not always be said that this technique is appropriate.

One objective of the present invention is to provide a printer that employs a platen roller as conveying means, for which the accuracy of the assembly of the constituents of a drive transmission mechanism that drives a platen roller is increased, and the heat releasing function of a motor that is a drive source is also improved, so that downsizing and increasing output can be coped with.

SUMMARY OF THE INVENTION

To achieve this objective, according to the present invention, a printer comprises:

a platen roller, for conveying a recording sheet, a print head, arranged opposite the platen roller, a drive unit, for rotating the platen roller, and a main frame, including a pair of side walls that can rotatably support the platen roller, wherein the drive unit includes: a motor; idler gears, for transmitting a rotational force provided by the motor to the platen roller; and a gear fitting member, integrally formed with gear support shafts that support the idler gears, wherein the motor and idler gears are capable of being mounted in the main frame while attached to the gear fitting member, and wherein a drive gear of the motor and the idler gears are stored in a space defined by the gear fitting member and one of the side walls of the main frame.

In addition, the gear fitting member is formed of an alloy material by die casting. Specifically, a material having a superior heat release property and an appropriate rigidity is preferable, and as an example, a zinc alloy, a magnesium alloy or a titanium alloy can be employed.

Further, the motor is attached through a flange member to the gear fitting member, and an engagement groove that is to be fitted in the distal end of the gear shaft is formed in the flange member. Thus, the positioning of a motor is performed by fitting the distal end of the gear shaft into the engagement groove. Further, a thermal head is prepared as printing means.

DETAILED DESCRIPTION OF THE INVENTION

Figure 1:
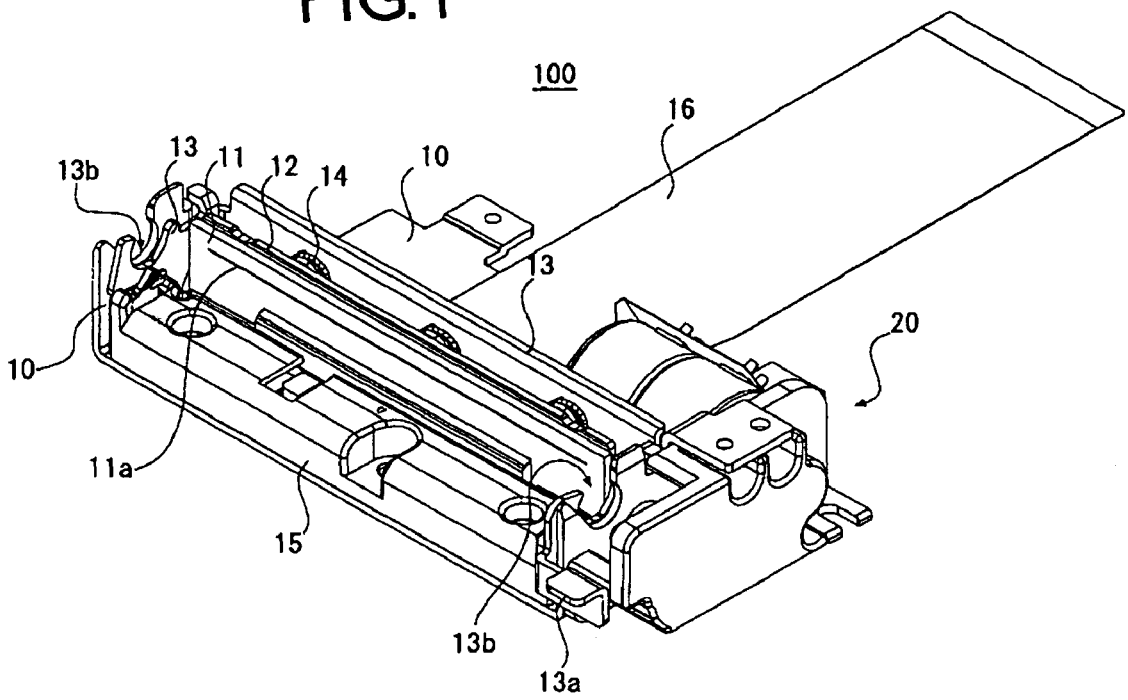
FIG. 1 is a perspective view of the printing portion of a thermal printer for which the present invention is applied.

A preferred mode according to the present invention will now be specifically described while referring to the drawings. In this mode, an explanation will be given for a portable thermal printer that is designed to be extended horizontally so as to perform comparatively wide printing, although not especially specified, and that prints, as a recording medium, a recording sheet with release paper such that an adhesive surface is exposed by peeling off the release paper on the reverse side.

Figure 2:
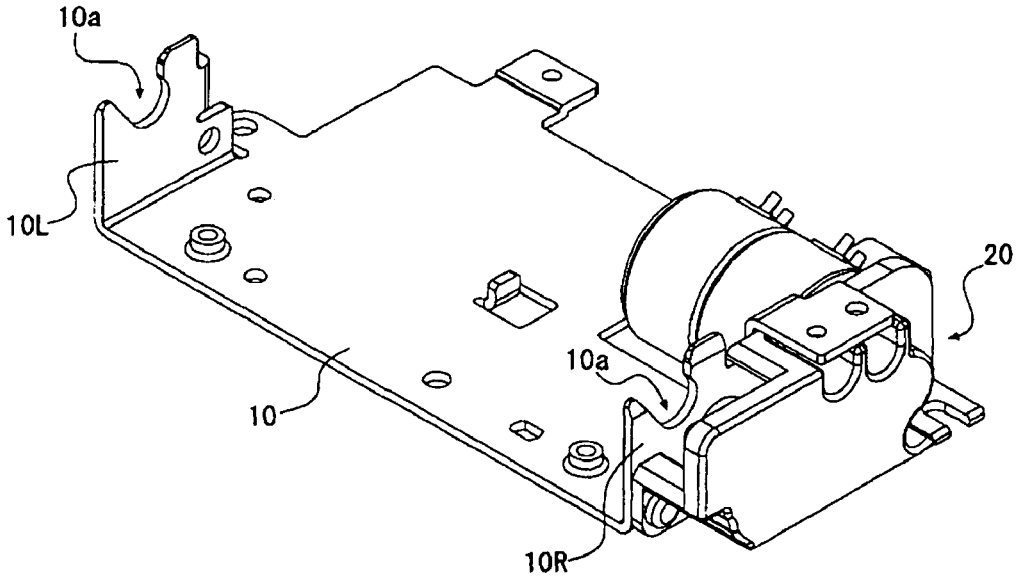
FIG. 2 is a perspective view of a main frame, from which all members except for a drive unit have been removed.

FIG. 1 is a perspective view of the printing portion of a thermal printer for which the present invention is applied. FIG. 2 is a perspective view of a main frame; from which all members other than a drive unit have been removed.

A thermal printer 100 according to this mode includes a printing portion constituted by: a thermal head 11, wherein a plurality of heat generating members 11*a* are horizontally arranged, in a line; a platen roller (not shown), for pressing a sheet against the thermal head 11 and conveying the sheet by rotating; a drive unit 20, for rotating the platen roller through a gear drive mechanism; and a main frame 10, to which the individual members can be attached.

The main frame 10 is formed of steel, through sheet metal processing, substantially in a half-rectangular shape that is formed by side walls, opposite each other in the direction of sheet width, and a bottom plate. Holder grooves 10*a*, 10*a*, for holding the rotary shaft of the platen roller, are provided in left and right walls 10L and 10R of the main frame 10. Also, in the left and right walls 10L and 10R, shaft holes 10*b*, 10*b* are formed to insert shafts (not shown) that pivotally support the thermal head 11 (or a head support member 12 securely fitted to the thermal head 11) and a lock arm member 13. In addition, screw holes (not shown) for securing the drive unit are formed in the right side wall 10R.

The lock arm member 13 is formed, entirely in a U shape, and hooks 13*b*, 13*b*, for securing the rotary shaft of the platen roller, and a shaft hole (not shown), for inserting the shaft, are formed at the left and right arm portions. The thermal head 11 is securely attached to the head support member 12 that functions as heat release means, for releasing heat generated by the thermal head 11. A plurality of coil springs 14, 14, . . . are fitted between the rear face of the head support member 12 and the lock arm member 13, and push against these two, so that the two can repel each other. Further, the rear face portion of the thermal head 13 is exposed below the rear face of the head support member 15, and an FPC (Flexible Print Circuit) 16 is connected at almost the center of the rear face portion of the thermal head 13 that is exposed. The lock arm member 13 and the thermal head 11 are rotatably supported by the shaft that is inserted through the shaft holes 10*b*, 10*b* of the main frame 10. Further, a paper guide 15 is attached in front of the thermal head 11.

With this structure, the arm of the lock arm member 13 is pulled backward by the coil springs 14. Thus, the rotary shaft of the platen roller is held in the holder grooves 10*a*, 10*a* of the main frame 10 and between the hooks 13*b*, 13*b* of the lock arm member 13, and the thermal head 11 is pressed against the platen roller. When an open/close lever 13*a*, which is arranged in the front portion of the right arm of the lock arm member 13, is pressed, and when the lock arm member 13 is pivoted at the shaft and the hooks 13*b* are released from the rotary shaft of the platen roller, the platen roller can be detached.

In this mode, the motor and the individual parts of the gear transmission mechanism are not directly mounted on the main frame 10, but instead these parts are first preassembled to form the drive unit 20, and thereafter, the drive unit it attached in a preassembled state to the main frame 10. This is one difference from the conventional printer.

Figure 3:
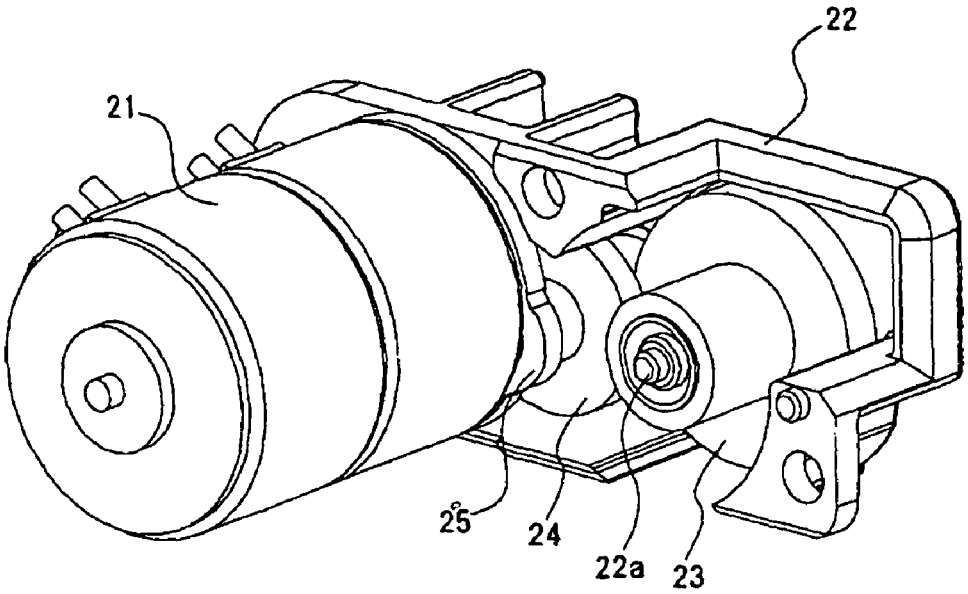
FIG. 3 is an enlarged perspective view of the drive unit.
Figure 4:
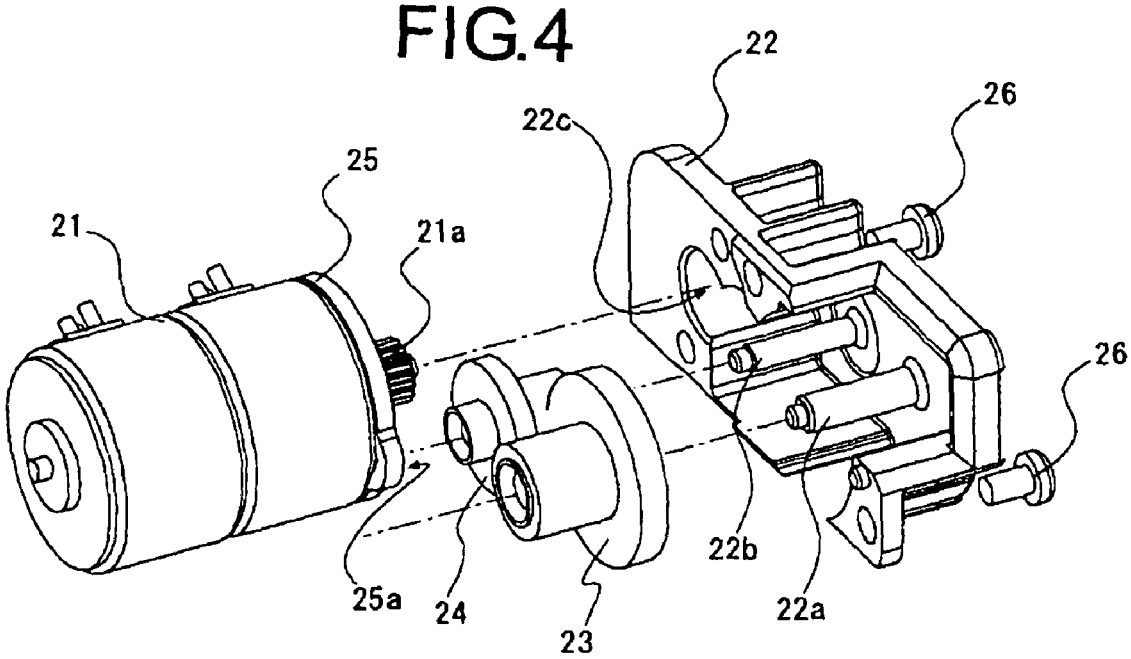
FIG. 4 is an exploded perspective view of the drive unit.
Figure 5:
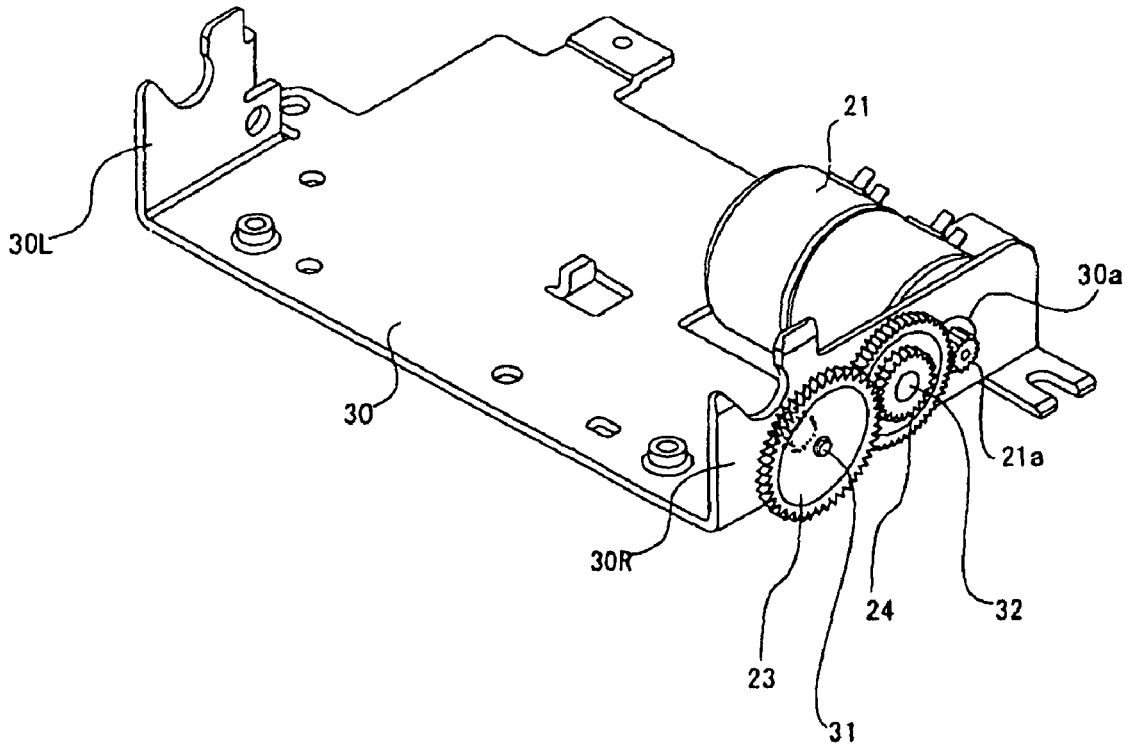
PRIOR ART FIG.5
FIG. 5 is a perspective view of a conventional drive transmission mechanism.

While referring to FIGS. 3 and 4, a specific explanation will be given for the drive unit 20 that is secured, by screws, to the right side wall 10R of the main frame 10. FIG. 3 is an enlarged perspective view of the drive unit, and FIG. 4 is an exploded perspective view of the drive unit.

The drive unit 20 includes idler gears 23, 24, for transmitting the rotational force provided by a rotary motor 21 to the platen roller; and a gear fitting member 22, which is a support member to which the idler gears 23, 24 are to be fitted.

Figure 6:
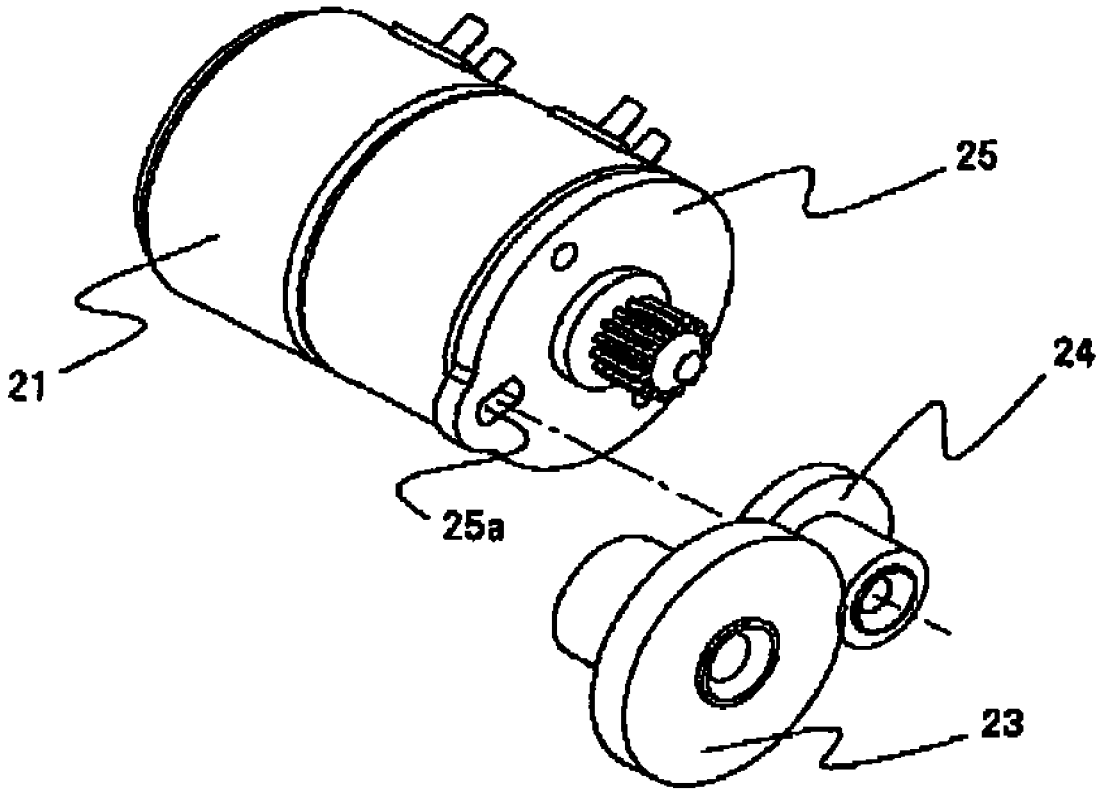
FIG. 6 is an exploded perspective view of the rotary motor and idler gears of the drive unit illustrated in FIGS. 3 and 4.

Specifically, the gear fitting member or support member 22 (referred to hereafter as gear fitting member) is made of a zinc alloy by die casting, and gear support shafts 22*a*, 22*b*, for supporting the idler gears 23, 24, are integrally formed. The idler gears 23, 24 are inserted and respectively fitted on the gear support shafts 22*a*, 22*b* of the gear fitting member 22. And in a state wherein the drive gear 21*a* is inserted into a storage portion 22*c* and engages the idler gear 24, the motor 21 is secured to the gear fitting member 22 by screws (not shown) at two locations. As illustrated in FIGS. 3-4, the gear fitting member 22 has two sections that are offset from one another, the motor 21 being mounted to one section and the gear support shafts 22*a*,22*b* extending from the other section. As a result, the drive unit 20 is provided. At this time, the distal end of the gear support shaft 22*b* is fitted into an opening in the form of an engagement groove 25*a* (shown in FIG. 6) that is formed in a motor flange (connecting flange) 25 and supports the idler gear 24 and also positions the motor 21. Further, since the motor is closely attached to the gear fitting member 22, heat generated by the motor 21 is released through the gear fitting member 22. Thus, it is preferable that the gear fitting member 22 be formed of a material having a superior heat release property.

When the preassembled drive unit 20 having the above structure is secured, by screws 26, to the right side wall 10R of the main frame 10, the distal end of the gear support shaft 22*a*is fitted into the engagement groove formed in the main frame 10 and supports the idler gear 23. Furthermore, when the platen roller is to be attached to the main frame 10 and the lock arm member 13, the coupled gear of the platen roller engages the idler gear 23, so that the rotation force provided by the motor 21 is transmitted to the platen roller.

As described above, since conventionally the gear support shafts are provided for the main frame by forcible insertion, this causes a variation in the inter-shaft distance for the individual gears. However, in this mode, since the gear support shafts 22*a*, 22*b* are integrally formed with the gear fitting member 22 by die casting, the accuracy of the assembly of the drive gear 21*a* of the motor, the idler gears 23, 24 and the coupled gear of the platen roller can be improved considerably. Therefore, since the variation in the inter-shaft distance for the gears is removed, the efficiency for the transmission of motor torque is increased, and the durability of the thermal printer is also increased. For example, the durability of the conventional thermal printer was 30 km for the sheet conveying distance, while in this embodiment, the durability was considerably increased to 50 km.

Furthermore, the drive unit 20, wherein the motor 21 and the idler gears 23, 24 are mounted and positioned on the gear fitting member 22, can be attached to the main frame 10. Thus, the assembly efficiency is considerably improved. Further, since the drive gear 21*a* of the motor 21 and the idler gears 23, 24 are stored in the space defined by the gear fitting member 22 and the right side wall 10R of the main frame 10, the entry of dust, etc., will not occur. That is, unlike the conventional case, a dust cover is not required to prevent the entry of dust, and the number of parts can be reduced.

In addition, since the accuracy for the mounting of the parts on the drive unit 20 can be improved, a predetermined accuracy can be maintained, even though the sizes of parts are reduced, and since the heat releasing function is superior, the downsizing of the printer and the increase in the output can also be coped with.

The invention provided by the present inventor has been specifically explained based on the illustrated mode. However, the present invention is not limited to the above described mode, and various modifications are available. For example, in the above mode, a zinc alloy is employed for the material of the gear fitting member 22. However, a magnesium alloy, a titanium alloy or another alloy that has a superior heat release property and an appropriate rigidity can also be employed. It is preferable that an alloy material be employed while taking heat resistance and heat releasing properties into account. However, the gear fitting member 22 can also be formed of a resin material, and in this case, the effects, such as the improvement of the assembly efficiency, can also be obtained.

INDUSTRIAL APPLICABILITY

According to the invention, since the gear support shafts, for supporting the idler gears, are integrally formed with the gear fitting member, the drive gear of the motor, the idler gears, and the coupled gear of the platen roller can be accurately assembled. Thus, since the variation in the inter-shaft distance between the gears can be removed, the efficiency for the transmission of motor torque can be improved, and energy saving can be provided.

Furthermore, since the drive unit, wherein the motor and idler gears are attached and positioned on the gear fitting member, can be mounted on the main frame, the assembly efficiency can be considerably increased. In addition, since the drive gear for the motor and the idler gears are stored in the space defined by the gear fitting member and one side wall of the main frame, the dust cover function can be provided without attaching a cover, as in the conventional case, and the number of parts can be reduced. Further, since heat generated by the motor is released through the gear fitting member, the heat releasing efficiency is improved, and the increase in the output can be coped with.

As described above, since the accuracy of the mounting of the gear transmission mechanism can be improved, a desired accuracy can be maintained even though the sizes of the parts are reduced, and since the heat releasing function is also superior, effects are obtained such that the downsizing of a printer and the increase in the output can be coped with.

In addition, since the gear fitting member is made of an alloy material by die casting, the gear support shaft can be formed at an extremely high processing accuracy. Further, since as an example, a zinc alloy, a magnesium alloy or a titanium alloy that has a superior heat release property and an appropriate rigidity is employed, heat generated by the motor can be efficiently released, and superior durability is provided.

Furthermore, the motor is mounted on the gear storage portion though the flange member, and the engagement groove into the distal end of the gear shaft is fitted are formed in the flange member. And since the positioning of the motor is performed by fitting the distal end of the gear shaft into the engagement groove, the accuracy of the assembly of the motor can be improved, and a variation in the inter-shaft distance between the drive gear of the motor and the idle gear can be removed.

Moreover, the preset invention is especially effective for a thermal printer for which downsizing and an increase in output are requested.

The invention claimed is:

1. A printer, comprising:

a platen roller for conveying a recording sheet, a print head arranged opposite the platen roller, a drive unit for rotating the platen roller, and a main frame, including a pair of side walls that rotatably support the platen roller, wherein the drive unit includes a motor for outputting a rotational force, idler gears for transmitting the rotational force outputted by the motor to the platen roller, and a gear fitting member integrally formed with gear support shafts that support the idler gears;

the motor and idler gears are capable of being mounted in the main frame while attached to the gear fitting member; and a drive gear of the motor and the idler gears are stored in a space defined by the gear fitting member and one of the side walls of the main frame; wherein the motor is attached through a flange member to the gear fitting member, and an engagement groove that is fitted in the distal end of one of the gear support shafts is formed in the flange member.

2. A printer according to claim 1, in that wherein the gear fitting member is formed of an alloy material by die casting.

3. A printer according to claim 2, wherein the alloy material is a zinc alloy, a magnesium alloy or a titanium alloy.

4. A printer according to claim 1, wherein the print head is a thermal head in which a plurality of heat generating members are arranged in a line.

5. A printer, comprising:

a main frame having two spaced-apart opposed side walls;

a platen roller rotatably supported by the two side walls;

a print head disposed opposite the platen roller; and a preassembled drive unit mounted in a preassembled state to one of the side walls for rotationally driving the platen roller, the preassembled drive unit comprising a support member integrally formed with gear support shafts, a rotary motor supported by the support member and having a drive gear, the rotary motor having a connecting flange by which the rotary motor is connected to the support member, the connecting flange having an opening in which is fitted a distal end of one of the gear support shafts, and idler gears rotatably mounted on respective gear support shafts for transmitting rotational movement of the drive gear to the platen roller, the drive gear and the idler gears being disposed in a space defined by the gear support member and the one side wall.

6. A printer according to claim 5; wherein the support member is a die-cast structure.

7. A printer according to claim 6; wherein the die-cast support member is formed of a zinc alloy, a magnesium alloy or a titanium alloy.

8. A printer according to claim 5; wherein the print head is a thermal head having heat generating members arranged in a line.

9. A printer according to claim 5; wherein the support member has a first section to which the rotary motor is mounted, and a second section offset from the first section and from which the gear support shafts extend.

10. A printer according to claim 5; wherein the support member is formed of a resin material.

* * * * *